United States Patent [19]

Plaisted

[11] 4,267,851

[45] May 19, 1981

[54] HAIR CURLING DEVICE

[75] Inventor: Richard E. Plaisted, Framingham, Mass.

[73] Assignee: The Gillette Company, Boston, Mass.

[21] Appl. No.: 47,367

[22] Filed: Jun. 11, 1979

[51] Int. Cl.[3] ..... A45D 2/12; A45D 4/18

[52] U.S. Cl. ..... 132/33 R; 132/39

[58] Field of Search ..... 132/33 R, 39, 34 R, 132/34 A, 37 R; 219/225, 227

[56] References Cited

U.S. PATENT DOCUMENTS

| | | | |
|---|---|---|---|
| 2,325,316 | 7/1943 | Haberman | 132/34 A |
| 2,809,642 | 10/1957 | King | 132/34 R |
| 2,905,186 | 9/1959 | Pfalzgraf | 132/33 R |
| 3,376,875 | 4/1968 | Rosan | 132/34 R |
| 3,399,684 | 9/1968 | Meli | 132/40 |
| 3,578,947 | 5/1971 | McNair | 132/33 |
| 3,918,465 | 11/1975 | Barradas | 219/225 |
| 4,075,458 | 2/1978 | Moyer | 219/227 |
| 4,145,600 | 3/1979 | Walter et al. | 132/33 R |

*Primary Examiner*—Paul J. Hirsch

*Attorney, Agent, or Firm*—Richard A. Wise; Raymond J. De Vellis

[57] ABSTRACT

A hair curling device including a heatable rod having a plurality of longitudinal channels. A non-conductive roller having a cage-like body is provided with a plurality of mating strips or bars. When the roller is slidably mounted on the rod, a sufficient heated surface area of the rod remains exposed for applying heat directly to a wound tress. The rod may be removed from the formed curl leaving the roller to support the hair while it cools to operate as a hair setter. If the rod remains mated to the roller and left in the hair while the hair cools, the device operates as a curling iron or styling wand.

12 Claims, 1 Drawing Figure

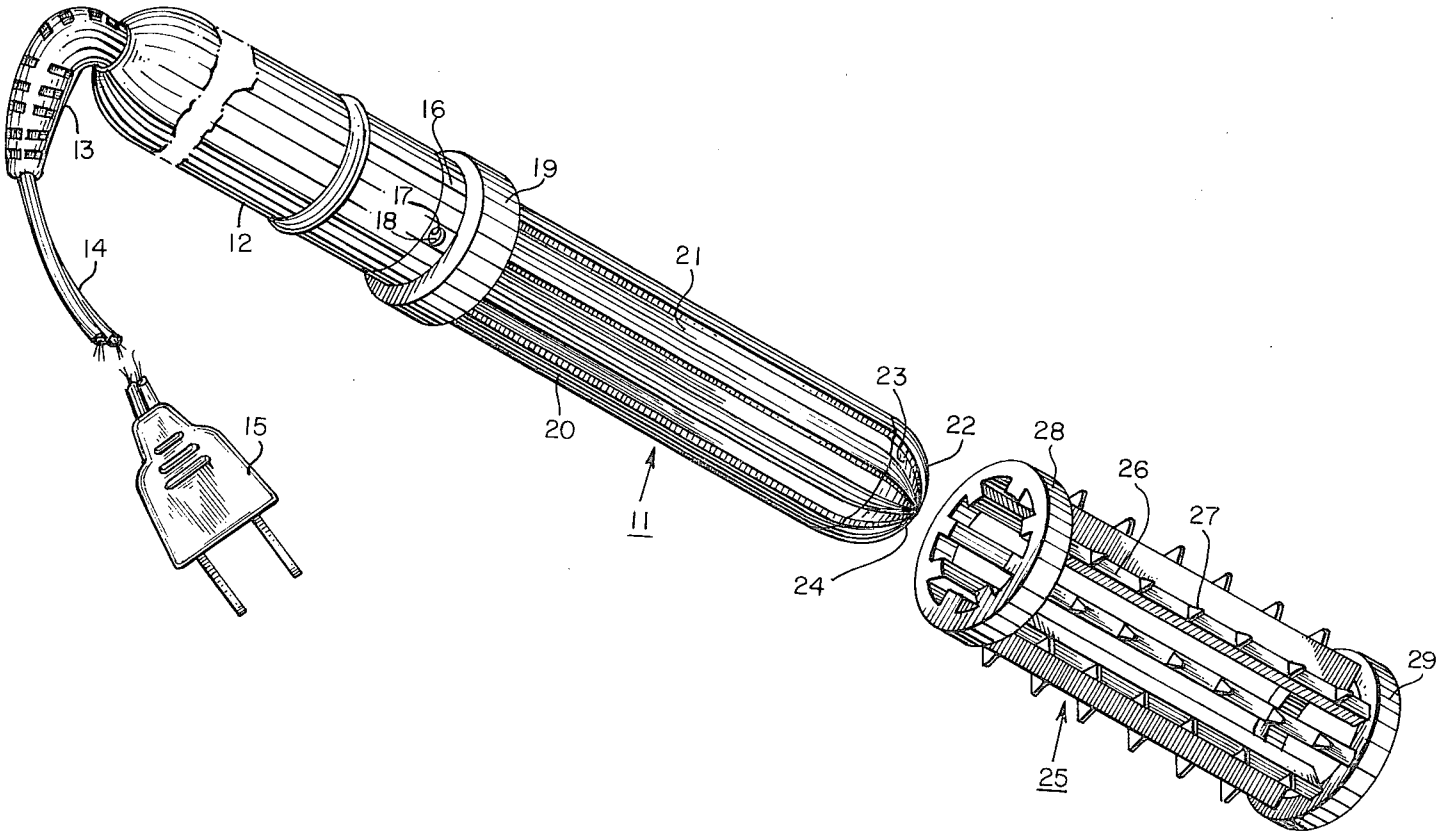
29
27
26
28
25
22
23
24
21
11
20
19
16
17
18
12
15
13
14

HAIR CURLING DEVICE

BACKGROUND OF THE INVENTION

This invention relates to hand-held hair curling devices. More particularly, this invention relates to a hair curling device which may be used as a curling iron or a hair setter.

In the past, rollers for heated hair setters were typically heated by a number of electrical heating pins mounted on a base in a chamber. The rollers were typically constructed of a heat retaining material such as a metal or filled with a heat storage material such as any well known eutectic material. Still other hair setters had their rollers heated by means of steam or the like. In each case the roller was the sole means of providing heat to the hair.

The large mass of such a roller, in the user's hair, necessitates a relatively long period of time for the consumer to curl her hair. Further, the weight of such a roller in the user's hair may cause unreasonable discomfort over an extended period of time.

The problems of the prior art have been substantially eliminated by providing a hair curling device having a continuously heated rod which applies its heat directly to the hair. An associated frame-like substantially non-conductive roller is provided to slidably mount on the heated rod to provide support for the hair while it cools when the heated rod is removed.

SUMMARY OF THE INVENTION

It is an object of this invention to provide a hair curling device which can be used as a hair setter which heats up and is ready to use quicker than prior art hair setters.

It is another object of this invention to provide a hair curling device which can be used as a hair setter which includes rollers which need stay in the hair for a shorter period of time than prior art hair setter rollers.

It is a further object of this invention to provide a hair curling device which can be used as a hair setter having rollers which are lightweight, comfortable to wear, and easy to handle.

It is still a further object of this invention to provide a hair curling device which can be used as a hair setter having rollers which require only common hair pins to secure the rollers to the wound tresses of the user.

It is a still further object of this invention to provide a hair curling device which can be used as a portable hair setter or, when an associated roller is left on the rod, as a portable styling wand.

Briefly stated and according to an aspect of this invention, a hair curling device is provided by using a continuously heated rod having a plurality of generally longitudinally disposed and generally radially displaced channels. A releasably mounted frame-like substantially non-conductive hair roller having a plurality of strips or bars slides into the channels of the rod so that a hair tress wound around the heated rod and mounted roller is in direct contact with a portion of the surface of the heated rod. Preferably, the height of the roller bar would be less than or substantially equal to the depth of the rod channel to assure that a substantial portion of the outer surface of the heated rod, such as at least about 50%, is in direct contact with the wound tress.

BRIEF DESCRIPTION OF THE DRAWING

The invention both as to its organization and principles of operation, together with further objects and advantages thereof, may better be understood by referring to the following detailed description of an embodiment of the invention taken in conjunction with the accompanying drawing in which the FIGURE is a perspective representation, partial in section, of an embodiment of the heated rod and its mating roller, in accordance with this invention.

DETAILED DESCRIPTION

A styling or curling wand referred to generally as wand 11 includes a generally cylindrical handle portion 12 made up of a non-conductive material such as a plastic. The free end of the handle 12 is adapted to receive a swivel connector 13 well known in the art. A line cord 14 connects the swivel connector 13 to a plug 15 and provides an electrical connection from an associated AC outlet to the wand 11 in a manner well known in the art.

Disposed next to the end of handle 12 which is opposite the swivel cord 13 is a ring 16 made of a polysulfone or the like. Pressed into a hole 17 formed in the surface of ring 16 is a color dot 18 which changes color when the operating temperature of the wand 11 is realized.

Disposed next to the ring 16 is an insulator ring or stop 19. The stop 19 is generally raised from the outer surface of the handle 12 and may be formed of a plastic or the like. The outer surface of the stop 19 may be grooved, dimpled, or otherwise textured, as desired. The stop 19, which has a larger outside diameter than that of the generally cylindrical handle 12, provides an integral stand to substantially prevent the heated wand 11 from touching resting surfaces as well as aiding in preventing the user of the wand 11 from sliding a hand onto the heated portion of the wand 11.

The stand 19, as well as the ring 16, may readily be formed as a single integral piece with the handle 12, all as well known in the art.

A heated rod 20 is connected to the handle 12 through the stand 19 and ring 16 in a manner well known in the art, such as by means of connecting sleeves located in the handle 12 and rod 20. The rod 20 is preferably made of a metal such as aluminum and may include a single rectangular PTCR pill electrically connected to cord 14 to provide the desired operating temperature, all as is well known in the art. Other manners of heating the rod 20 may be provided such as by using a resistance wire heater with an associated thermostat. The preferred operating temperature of the rod 20 at its outer surface should be approximately in the range of 130° to 150° C.

The rod 20 includes a plurality, such as eight in number, of generally longitudinal channels substantially equally spaced apart about the circumference of rod 20. The channels, such as channel 21, are generally displaced and run substantially the length of the rod 20 and at least includes the hair winding portion thereof. In an exemplary embodiment, the length of the rod 20 is approximately two and one-half inches long. The number and size of the longitudinally disposed channels are such that preferably a minimum of about one-half the circumference or outer surface area of the rod 20 is available to come in direct contact with the hair when an associated roller is in place. The amount of heat transmitted to the tress of hair will increase as the contact surface area of the rod increases. The minimum number of channels, and the corresponding longitudinal bars of the associated roller, will depend primarily on the desired structural rigidity of the associated roller.

The depth and shape of the channels in the rod 20, such as in channel 21, are not critical parameters for the practice of this invention. That is, there is no need for the longitudinal bars of the associated roller to exactly mate and totally fill up the channels of the rod 20, nor is there any criticality in the bottom surface of the channels being evenly radially disposed from the center axis of the rod 20.

Mounted on the free end of the rod 20 is a cool tip 22. The cool tip 22 may be formed of a plastic such as polysulphone and includes a plurality of aligned channels such as channel 23 which is aligned with channel 21 of rod 20. Preferably, the cool tip 22 includes a like number of channels as does the rod 20. Further, cool tip 22 has a generally tapered end 24 which flairs out and mates with the free end of rod 20 to provide easy alignment and lead-in for the longitudinal bars or teeth strips of the associated roller. The cool tip 20 may be connected to the end of the rod 20 by any mechanical fastening means well known in the art such as by crimping.

The associated roller referred to generally by the numeral 25 includes a plurality (such as eight in number) of teeth strips or bars, such as bar 26. Each bar, in an exemplary embodiment is equally spaced on the circumference of a circle that is slightly larger than that of the channels on the heated rod and may be about two and one-half inches long and one-half inch thick. Each bar may include a plurality of teeth such as tooth 27 to aid in gripping and securing the hair of the user and forming a curl. The size and shape, as well as the number of teeth, or other hair gripping means, included on the roller 25 may be varied to provide ease of gripping and handling as well as comfort. In an exemplary embodiment, adjacent teeth on each bar may be approximately five-sixteenths of an inch apart. Each bar of the roller 25 is held in place by ring 28 and 29 formed at each end of the roller 25. The size and diameter of the rings 28 and 29 may vary depending upon the size of the desired curl.

As can be seen by the mating of the bars of rollers 25 to the rings 28 and 29, the height of the bars of rollers 25 will mate with the associated channels of the rod 20 such that the base or top surface (the surface upon which the teeth are mounted) will conform to the general cylindrical shape of the outer surface of the rod 20. The outer surface of the bars of roller 25 are formed not to substantially protrude from the normal shape of the outer surface of rod 20. That is, the height of the bars of the roller 25 will preferably be such that they will be less than or substantially equal to the depth of their respective mating channels of rod 20.

The roller 25 may be made in a variety of ways such as by injection molding the roller 25 to form a single integral piece. A material suitable for such construction of the roller 25 is a nylon 6/6. In general, the material chosen to construct the frame-like roller 25 should be substantially non-heat conductive and allow the proper structural integrity to support a wound tress while not substantially hampering the cooling process in which the tress forms its curl.

If desired, interlock means for securing the roller in place of the rod of the wand may be provided. The interlocking means, not shown, may comprise a detent lock or the like such as accomplished by dimples or bumps on the rod or roller to provide a lock, slip fit well known in the art so that the roller will not slide off the rod unless urged off by the user.

In operation the heated rod is allowed to heat up such as for approximately five minutes. A roller is placed on the rod and immediately, with the aid of the roller teeth, a section of hair is rolled onto the rod. When the rollers are on the heated rod, there is heated metal barrel between each row of teeth and on a slightly higher level than the base of the teeth. This allows the barrel or rod to be able to come into direct contact with the hair.

The rod need only be held in the hair such as for a minimum of ten seconds. The user will then grip the roller and remove the heated rod from it. The rollers easily slide on and off the rod guided by the plastic cool tip which provides easy alignment of the teeth strips with the channels in the rod.

No special pins or rollers fastening means are required to pin or otherwise secure the roller to the user's hair, as is common with other hair setter rollers. Only simple, blunt, straight hair pins are needed. Such pins are readily available from a variety of sources.

The user will then set the handle down and pin the hair in place by passing a simple straight pin through the open slots in the roller securing it in place. The operator will then pick up another roller and repeat the process until all tresses are rolled. The comfortable lightweight roller provides a frame for quick cooling to lock in the curl into the trees. When a wound tress cools to at least below approximately 50° C., the roller may be removed.

If desired, moisture such as a mist or steam could readily be applied to the rollers by spray misting or dipping the rollers in water and shaking the excess water off the rollers before placing them on the heated wand. The use of a pump sprayer for misting the rollers is a preferable method of applying moisture to the roller.

A plurality of multi-sized rollers may be included with the heated want to permit a plurality of rollers to be left in the hair, in the general manner of use as is common with hair setters. Since there is no necessity to separately heat the rollers in a box or steam chamber, the wand/roller combination of this invention may conveniently act as a portable hair setter in which the wand and several rollers are carried in a purse or the like.

If the user desires to use the wand/roller combination in the nature of a styling wand or hair curler, the user would simply leave one roller on the rod portion of the wand and use the unit in a manner such as when one uses a curling iron having a plurality of non-conductive teeth at its rod end. This, of course, requires the user to form a single curl at a time and wait an appropriate amount of time for the curl to set in the tress and then unwind the wrapped tress before forming a second tress.

While an embodiment and application of this invention has been shown and described, it will be apparent to those skilled in the art that many more modifications will be possible without departing from the inventive concepts herein described.

What is claimed as new and desired to be secured by Letters Patent of the United States is:

1. A curling device comprising:

an elongated tubular heat conductive rod portion defining a heating chamber and having first and second ends and a hair winding portion disposed between said first and second ends, said hair winding portion including a plurality of longitudinal channels;

heating means disposed in said heating chamber for providing heat to said hair winding portion; and a tubular cage-like roller member, having first and second open ends, slidably mountable on said hair winding portion of said rod through either said first or second open end, said roller member including a plurality of longitudinal bars, each bar having a height substantially equal to or less than the depth of said mating channels of said rod so that a wound tress will be in direct contact with the outer surface of a substantial portion of said hair winding portion.

2. The curling device as in claim 1 wherein the substantial portion of said hair winding portion is at least 50% of the outer surface of said hair winding portion.

3. The curling device as in claim 2 wherein said roller member includes a plurality of teeth on each said longitudinal bar.

4. The curling device as in claim 3 wherein said roller member is substantially non-heat conductive.

5. The curling device as in cliam 4 wherein said first end of said rod portion is connected to a generally cylindrical handle portion.

6. The curling device as in claim 5 wherein said second end of said rod portion is coupled to a tapered cool tip which includes a plurality of mating channels to provide ease of alignment to said mating roller member.

7. The curling device as in claim 6 wherein said longitudinal channels are radially displaced from the center axis of said rod portion.

8. The curling device as in claim 7 wherein said channels are eight in number.

9. A curling device comprising:

an elongated tubular heat conductive rod portion defining a heating chamber and having first and second ends and a hair winding portion disposed between said first and second ends, said hair winding portion including a plurality of longitudinal channels;

a handle connected to said first end of said rod portion;

a cool tip with mating channels connected to said second end of said rod portion;

heating means disposed in said heating chamber for providing heat to said hair winding portion; and a roller member, having first and second open ends, slidably mountable on said hair winding portion of said rod through either said first or second open end, said roller member including a plurality of longitudinal bars, each bar having a height substantially equal to or less than the depth of said mating channels of said rod so that a wound tress will be in direct contact with part of the outer surface of said hair winding portion.

10. The curling device as in claim 9 wherein the part of said hair winding portion is at least 50% of the outer surface of said hair winding portion.

11. The curling device as in claim 10 wherein said roller member includes a plurality of teeth on each said longitudinal bar.

12. The curling device as in claim 11 wherein said roller member is substantially non-heat conductive.

* * * * *